US006577235B2

(12) United States Patent
Frys

(10) Patent No.: US 6,577,235 B2
(45) Date of Patent: Jun. 10, 2003

(54) ADJUSTABLE DOOR HINGE MONITORING DEVICE

(75) Inventor: Thomas J. Frys, Crittenden, NY (US)

(73) Assignee: Markar Products, Inc., Lancaster, NY (US)

( * ) Notice: Subject to any disclaimer, the term of this patent is extended or adjusted under 35 U.S.C. 154(b) by 77 days.

(21) Appl. No.: 09/845,972

(22) Filed: May 1, 2001

(65) Prior Publication Data

US 2002/0162193 A1 Nov. 7, 2002

(51) Int. Cl.[7] ..... G08B 13/08

(52) U.S. Cl. ..... 340/547; 340/545.1; 340/545.3; 340/551; 340/572.4; 340/572.6; 335/153; 335/205; 335/207

(58) Field of Search ..... 340/547, 545.1, 340/545.7, 545.8, 545.6, 551, 550, 561, 567, 572.8; 335/205, 153, 207

(56) References Cited

U.S. PATENT DOCUMENTS 4,072,917 A * 2/1978 Haag et al. ..... 200/61.7
4,213,110 A * 7/1980 Holce ..... 335/153
4,292,629 A * 9/1981 Kerr et al. ..... 200/61.69

* cited by examiner

*Primary Examiner*—Daniel J. Wu
*Assistant Examiner*—Son Tang

(57) ABSTRACT

The invention is in a device for monitoring the position of a swinging door that is mounted on a stationary frame, the device essentially comprises a magnet and magnetic proximity sensor which are mounted in coaxially aligned relation on a pair of opposing leafs of a hinge. Means are provided for moving the magnet to and from the sensor to correspondingly vary the gap or spacing between them.

7 Claims, 2 Drawing Sheets

FIG.-1
Prior Art
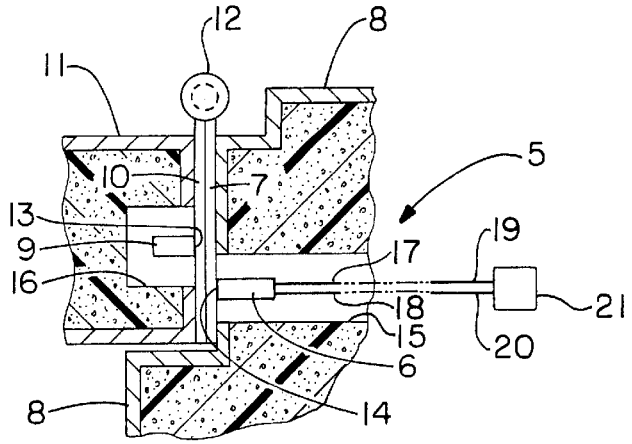
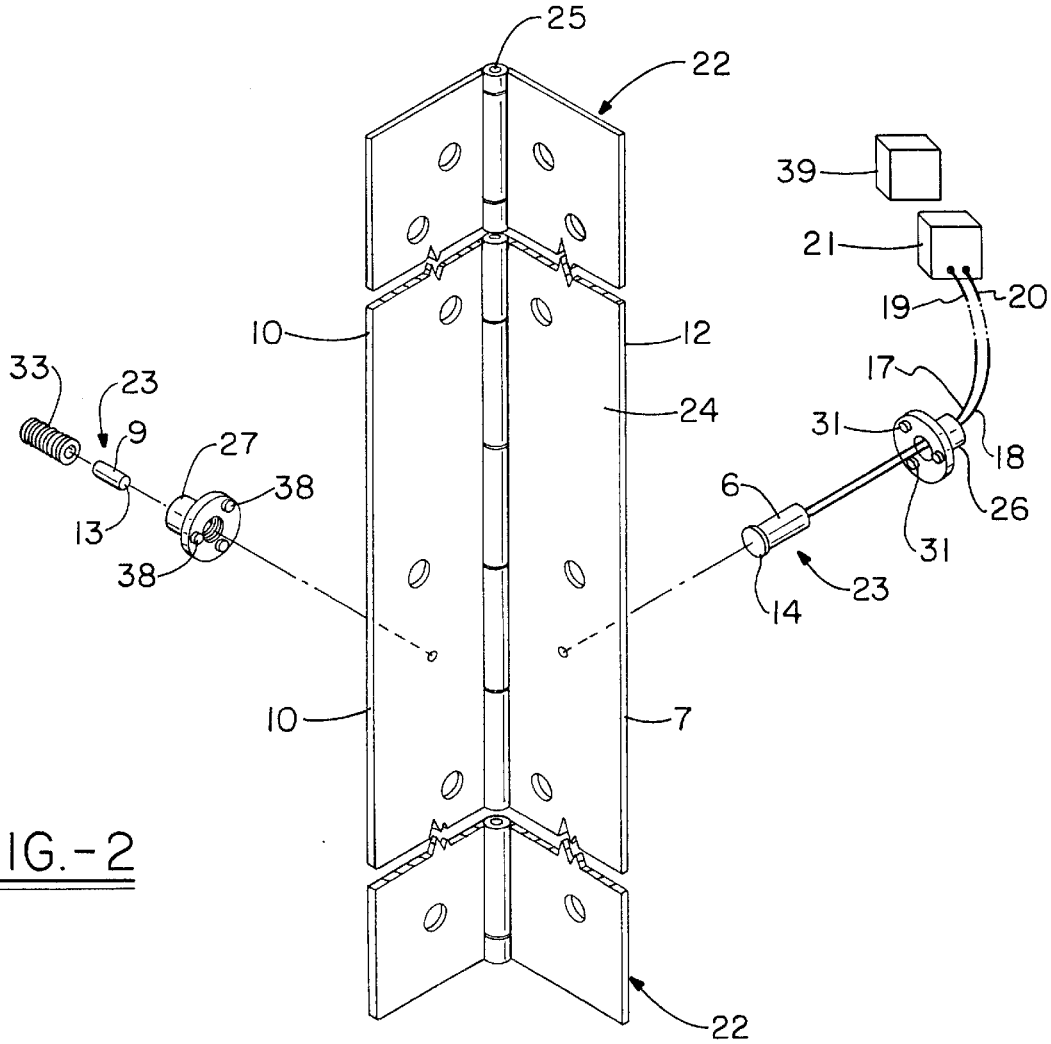
FIG.-2

ADJUSTABLE DOOR HINGE MONITORING DEVICE

BACKGROUND OF THE INVENTION

The invention relates to hinges, especially piano type hinges which are used to mount a swinging door to a fixed door frame. Such doors may be made of any suitable material, such as wood, plastic, or metal, and the hinges may be made of any appropriate material, including plastic or metal, such as aluminum, steel or brass.

More particularly, the invention is in a magnetic device for monitoring the opening and closing of a door as it swings to and from a closed position in a fixed door frame to which the door is mounted.

DESCRIPTION OF THE DRAWINGS

The following description of the invention will be better understood by having reference to the accompanying drawing, wherein:

FIG. 1 is a partial sectional view which is designed to show a prior art door monitoring device;

FIG. 2 is a perspective view of a piano hinge and door monitoring device which is made in accordance with the invention.

DETAILED DESCRIPTION OF THE DRAWING

Figure 3:
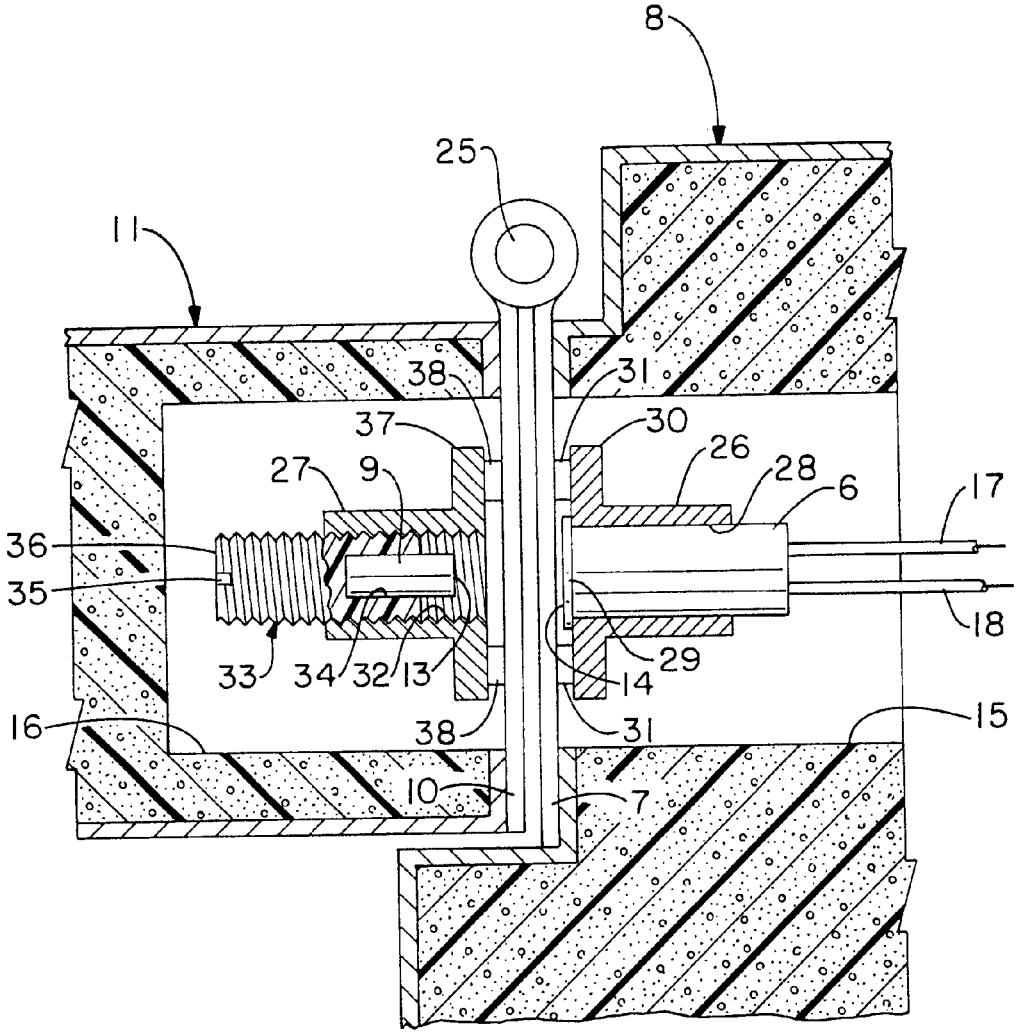
FIG. 3 is a cross sectional view which is designed to show the door monitoring device of the invention in greater detail, when it is mounted on the leafs of a door hinge.

With general reference to the drawing for like parts and particular reference to FIG. 1, there is shown a prior art door monitoring device 5 which essentially comprises conventional components of, 1) a cylindrical magnetic proximity sensor 6 which is secured by any suitable adhesive to a hinge leaf 7 which is fastened by screws to an adjacent, fixed door frame 8, and 2) a cylindrical neodymium iron boron magnet 9 which is, likewise, secured by an adhesive to the opposing hinge leaf 10 which is fastened by screws to a door 11 which, in turn, is mounted for swinging relation on the fixed door frame 8 by the fixed and rotary leafs 7 and 10 of a hinge 12.

It is well known by those skilled in the art, that the north pole 13 of the magnet 9 should be placed in abutting relation with the rotary hinge leaf 10 and in confronting relation with the south pole 14 of the sensor 6 which is in abutting relation with the opposing stationary hinge leaf 7. Moreover, for optimum operation of the DM (door monitoring) device 5, there should be a predetermined gap between the magnetic fields of the sensor 6 and magnet 9, such gap being more easily viewed and measured as the corresponding gap or spacing between the north and south poles 13 and 14 of the magnet 9 and sensor 6. This is accomplished in the prior art by securing the sensor 6 and magnet 9 in predetermined axially offset relation on the fixed and rotary hinges 7 and 11, where the sensor 6 and magnet 9 extend into adjacent openings 15 and 16, respectively, in the door frame 8 and door 11, as best seen when the hinge 12 is in a closed position where the hinge leafs 7 and 10 are adjacently disposed in abutting or closest spaced relation as shown in FIG. 1. The sensor 6 has a pair of electrical lead wires 17 and 18 which are electrically connected to a pair of similar wires 19 and 20 for carrying low voltage electric current from the sensor 6 to a remotely located signaling device 21, such as a buzzeR, bell, or ligh which, for example, can be used in conjunction with a centralized security system.

Unfortunately, the sensor 6 or magnet 9 of prior art DM devices 5 are occasionally, accidentally knocked off during transportation or installation of the DM devices 5, thereby necessitating the replacement of the component with a new one in exactly the same spot, which is not always easy to do in the field. The invention overcomes this problem by the provision of an improved DM device 5 wherein, 1) the sensor 6 and magnet 9 are firmly secured in axially aligned relation to the leafs 7 and 10 of the hinge 12, so that they can not be accidentally knocked off from the hinge 12, and 2) the gap between the sensor 6 and magnet 9 is easily adjusted.

With reference to FIGS. 2 and 3, there is shown a metal piano-type hinge 22 which is substantially coextensive with the height of the door 11, when the door 11 is mounted on the fixed door frame 8. The hinge 12 to which the new improved DM device 23 of the invention is operatively connected, is an independent metal section 24 of the piano hinge 23, which section 24 is about 12 inches, in length, and is disposed centrally between the opposing ends of the piano-hinge 22, and includes a metal hinge pin 25 that is common to the piano hinge 22. In instances where three hinges are used to mount the door 11, the DM device 23 is operatively connected to the middle hinge.

The new DM device 23 comprises a pair of stainless steel members, e.g. rigid weld nuts 26 and 27 which are disposed on the hinge leafs 7 and 10, respectively, in opposed confronting relation, when the door 11 is closed and the hinge leafs 7 and 10 are in closest spaced relation, as best seen in FIG. 3.

The first weld nut 26 is mounted in outstanding relation on the fixed hinge leaf 7 that is secured to the door frame 8, and has a smooth, cylindrical center bore 28 which has a longitudinal axis that is normal to the plane of the fixed hinge leaf 7. The sensor 6, in this instance, is provided with an outstanding annular stop 29 which engages the first weld nut 26 when the sensor 6 is properly press-fitted in the smooth bore 28 where the longitudinal axis of the sensor 6 is also normal to the plane of the stationary hinge leaf 7. The first weld nut 26 is provided with an outstanding annular flange 30 around which are equally, angularly spaced three, similar projections 31 which are welded to the stationary hinge leaf 7.

The second, stainless steel weld nut 27 is mounted in outstanding relation on the rotary hinge leaf 10 that is secured to the swinging door 11, and has an internally threaded, center bore 32 which has a longitudinal axis that is normal to the plane of the rotary hinge leaf 10. The threaded bore 32 is designed to threadably receive an externally threaded nylon rod 33 which has a centrally disposed, smooth cylindrical recess 34 in which the cylindrical magnet 9 is press-fitted and extends therefrom in the direction on the adjacent rotary hinge leaf 10 in axially aligned with the confronting sensor 6, when the door 11 is closed. The threaded rod 33 has a slot 35 at its opposing end 36 for receiving a tool for rotating the threaded rod 33 and attached magnet 9 into and out of the internally threaded bore 32 to adjust the size of the gap or spacing between the axially aligned sensor 6 and magnet 9. The second weld nut 27 has a similar, outstanding annular flange 37 around which are equally angularly spaced, three similar projections 38 which are welded to the rotary hinge leaf 10.

Thus, there has been described a unique device for monitoring the opening and closing of a swinging door that is mounted on a fixed door frame. The DM devices 23 can be used in conjunction with a number of television cameras and screens 39 to visually show an operator when doors are not properly closed and remain open or slightly ajar.

What is claimed is:

1. A continuous, piano-type swinging door hinge and door monitoring device, comprising:

a) a first and a second leaf hinged together by a single pivot pin for relative swinging rotation, the leafs and pivot pin being substantially coextensive with the height of a door when the door is hinged to an adjacent side frame of a fixed opening, each leaf having a relatively short section between opposing ends thereof, the leaf sections being separate from adjacent portions of the leafs and hinged together by the single pivot pin for unitary and independent swinging rotation with, and relative to, said portions of the leafs;

b) a magnetic proximity sensor;

c) a first means for securing the sensor to the section of the first leaf, the first means including a hollow first cylinder with an outstanding flange which is firmly secured to the flat surface of the first leaf section farthest spaced from the second leaf when the hinge is closed where the leafs are in closest spaced relation, the first cylinder having a longitudinal axis which is normal to the first leaf section and designed to detachably receive the sensor therein, such that the sensor is in fixed, closely spaced relation to the flat surface of the first leaf section;

d) a magnet;

e) a second means for securing the magnet to the second leaf section, such that the magnet and sensor are in confronting spaced relation, when the hinge is closed, the second means including, i) an internally threaded, hollow second cylinder with an outstanding flange which is firmly secured to a flat surface of the second leaf section farthest spaced from the first leaf section when the hinge is closed, the second cylinder having a longitudinal axis which is coaxially aligned with the first cylinder when the hinge is closed, and ii) an externally threaded, hollow third cylinder threadably received in the second cylinder in coaxially alignment, the magnet being detachably secured in the hollow third cylinder and protruding therefrom into the hollow second cylinder for confronting relation with the sensor; and f) a third means for rotating the third cylinder and attached magnet within the second cylinder to and from the sensor to vary the gap between the magnet and sensor.

2. The hinge and door monitoring device of claim 1, wherein the sensor and magnet are each generally cylindrical, in shape, and the sensor has an outstanding annular flange which abuts the first cylinder, when the sensor is, in position, within the first cylinder.

3. The hinge and door monitoring device of claim 2, wherein the third means includes a configured opening in the outer end of the third cylinder for receiving a tool for rotating the third cylinder to move the magnet axially to and from the sensor.

4. The hinge and door monitoring device of claim 3, which includes:

g) an electrically responsive signaling device remote from the sensor; and h) means for electrically connecting the sensor to the signaling device to carry low voltage electric current from the sensor to the signaling device.

5. The hinge and door monitoring device of claim 4, wherein each of the first and second cylinders with outstanding annular flanges include a weld nut which has an outstanding annular flange around which are equally angularly spaced a plurality of similar size projections for welding to adjacent metal hinge leaf sections.

6. The device of claim 5, wherein metals used in the device are metals from the group of aluminum, steel, stainless steel, brass and bronze.

7. The hinge and door monitoring device of claim 5, wherein the leaf sections have the same length, measured longitudinally of the hinge, of about twelve inches.

* * * * *